US006095211A

United States Patent [19]

Chiang

[11] Patent Number: 6,095,211

[45] Date of Patent: Aug. 1, 2000

[54] CUTTER DEVICE FOR A WOOD PLANING MACHINE

[76] Inventor: Pei-Lieh Chiang, No. 12, Nan-Ping Rd., Nan Dist., Taichung City, Taiwan

[21] Appl. No.: 09/371,238

[22] Filed: Aug. 10, 1999

[51] Int. Cl.[7] ..... B27C 5/00

[52] U.S. Cl. ..... 144/230; 144/117.1; 144/218; 407/41

[58] Field of Search ..... 144/114.1, 116, 144/117.1, 48, 225, 229, 230; 407/40, 41, 49, 87, 108

[56] References Cited

U.S. PATENT DOCUMENTS

| | | | |
|---|---|---|---|
| 4,243,085 | 1/1981 | Gemmani | 144/230 |
| 4,449,556 | 5/1984 | Colton | 407/41 |
| 4,475,425 | 10/1984 | Punater et al. | 144/230 |
| 4,658,875 | 4/1987 | Grabovac | 144/230 |
| 5,398,739 | 3/1995 | Everts et al. | 144/117.1 |

*Primary Examiner*—W. Donald Bray
*Attorney, Agent, or Firm*—Brooks & Kushman P.C.

[57] ABSTRACT

A cutter device includes a cylindrical cutter seat having opposite end faces and a cylindrical surface between the end faces. A coupling shaft extends co-axially from a respective one of the end faces. The cylindrical surface is formed with an axially extending cutter receiving groove between the end faces to receive a cutting blade therein. The cutter receiving groove is defined by a blade supporting wall, a fastener bearing wall, and a groove bottom interconnecting the blade supporting wall and the fastener bearing wall. Each of two positioning members is sleeved on a respective one of the coupling shafts, and has a large-diameter ring portion and a small-diameter ring portion that extends co-axially therefrom toward a respective one of the end faces of the cutter seat such that the large-diameter ring portion abuts against a respective lateral end portion of the cutting blade and such that a base edge of the cutting blade is supported on the small-diameter ring portion. A longitudinal blade edge of the cutting blade projects relative to the cylindrical surface.

15 Claims, 6 Drawing Sheets

CUTTER DEVICE FOR A WOOD PLANING MACHINE

BACKGROUND OF THE INVENTION

1. Field of the Invention

The invention relates to a cutter device, more particularly to a cutter device for a wood planing machine.

2. Description of the Related Art

Referring to FIG. 1, a conventional wood planing machine 10 is shown to include a machine base 11, left and right pairs of upright posts 12 extending upwardly from two mounting sides of the base 11, and a carriage assembly 13 movable along the upright posts 12. A cutter device 20 (see FIG. 2) is mounted on the carriage assembly 13. The carriage assembly 13 is movable relative to the base 11 so as to define a gap therebetween for passage of a workpiece 14 that is to be planed by the cutter device 20.

As illustrated in FIGS. 2 and 3, the cutter device 20 includes a cylindrical cutter seat 21, two elongate cutting blades 22, two elongate press members 23, and two releasable tightening units. The cylindrical cutting seat 21 has opposite end faces 210, and a cylindrical surface 212 between the end faces 210. Each of the end faces 210 has a coupling shaft 211 that extends co-axially therefrom for coupling with a motor (not shown). The cylindrical surface 212 is formed with a pair of axially extending cutter receiving grooves 24 that extend from one of the end faces 210 to the other one of the end faces 210. Each cutter receiving groove 24 is defined by a blade supporting wall 242, a fastener bearing wall 243 opposite to the blade supporting wall 242, and a groove bottom 241 interconnecting the blade supporting wall 242 and the fastener bearing wall 242. Each cutting blade 22 is disposed in the respective cutter receiving groove 24, and has a wall bearing side 224 that leans on the blade supporting wall 242, a force bearing side 225 opposite to the wall bearing side 224, a longitudinal base edge 222, and a longitudinal blade edge 221 that is opposite to the base edge 222 and that projects relative to the cylindrical surface 212 of the cutter seat 21. Each press member 23 is disposed in the respective cutter receiving groove 24 adjacent to the force bearing side 225 of the respective cutting blade 22. Each releasable tightening unit includes a plurality of tightening fasteners 231 that force the respective press member 23 away from the fastener bearing wall 243 to enable the press member 23 to press tightly the corresponding cutting blade 22 against the blade supporting wall 242.

Some disadvantages that result from the use of the aforesaid conventional wood planing machine 10 are as follows:

(i) It is noted that two biasing springs 26 are disposed in recesses 25 formed in the groove bottom 241 to support the base edge 222 such that the blade edge 221 of the cutting blade 22 projects relative to the cylindrical surface 212. As such, during replacement of the cutting blade 22,the blade edge 221 cannot be arranged with ease to project uniformly from the cylindrical surface 212 due to spring fatigue or unequal biasing forces of the springs 26, thereby inconveniencing the replacement operation.

(ii) The fastener bearing wall 243 is inclined relative to the blade supporting wall 242 so as to define a narrow opening for access to the groove bottom 241 in order to prevent removal of the cutting blade 22 when the cutter seat 21 rotates. However, the fastener bearing wall 243 intersects with a reference plane 244, that is generally parallel to the blade supporting wall 242 and that passes through the axis of the cylindrical seat 21 and forms an acute angle of 15 degrees therewith. Accordingly, the cross sectional area of the cutter seat 21 is relatively small, thereby weakening an overall rigidity of the cutter seat 21.

SUMMARY OF THE INVENTION

Therefore, the object of this invention is to provide a cutter device adapted for use in a wood planing machine and which is clear of the aforementioned disadvantages that are commonly associated with the conventional wood planing machine.

Accordingly, a cutter device of the present invention is adapted for use in a planing machine, and includes a cylindrical cutter seat, a pair of positioning members, an elongate cutting blade, an elongate press member, and a releasable tightening unit. The cylindrical cutter seat has opposite end faces and a cylindrical surface between the end faces. Each of the end faces has a coupling shaft that extends co-axially therefrom. The cylindrical surface is formed with an axially extending cutter receiving groove that extends from one of the end faces through the other one of the end faces. The cutter receiving groove is defined by a blade supporting wall, a fastener bearing wall opposite to the blade supporting wall, and a groove bottom that interconnects the blade supporting wall and the fastener bearing wall. Each of the positioning members is sleeved on a respective one of the coupling shafts of the cutter seat, and has a large-diameter ring portion and a small-diameter ring portion that extends co-axially from one side of the large-diameter ring portion toward a respective one of the end faces of the cutter seat. The cutting blade is disposed in the cutter receiving groove, and has a wall bearing side that leans on the blade supporting wall, a force bearing side opposite to the wall bearing side, a longitudinal base edge, and a longitudinal blade edge that is opposite to the base edge and that projects relative to the cylindrical surface of the cutter seat. The cutting blade further has opposite lateral end portions, each of which projects relative to a respective one of the end faces of the cutter seat and abuts against the large-diameter ring portion of a respective one of the positioning members. The base edge of the cutting blade is supported on the small-diameter ring portions of the positioning members at the lateral end portions of the cutting blade. The press member is disposed in the cutter receiving groove adjacent to the force bearing side of the cutting blade. The releasable tightening unit forces the press member away from the fastener bearing wall to enable the press member to press tightly the cutting blade against the base supporting wall.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
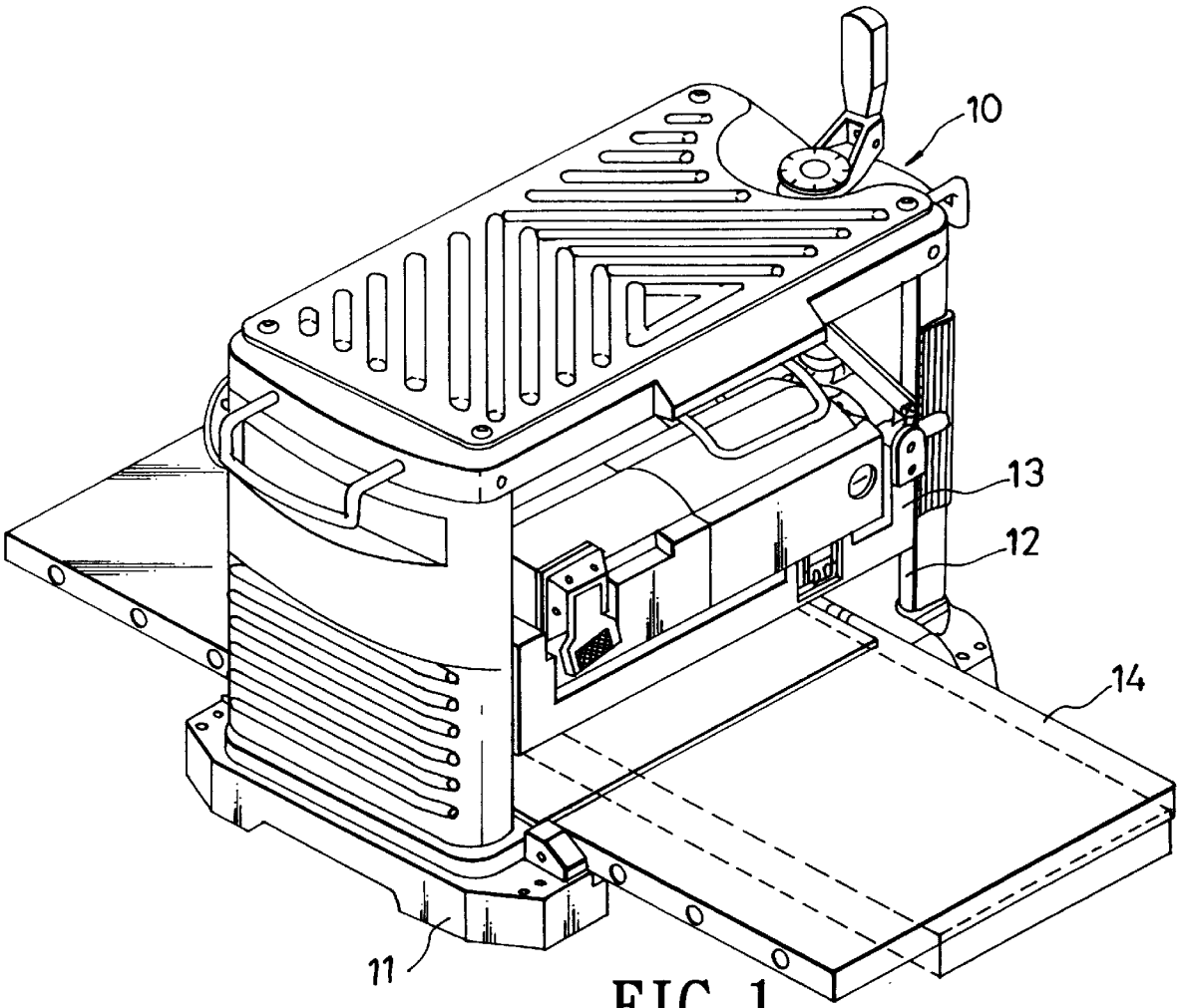
FIG. 1 PRIOR ART
FIG. 1 is a perspective view of a wood planing machine incorporating a conventional cutter device for planing a workpiece fed therethrough.
Figure 2:
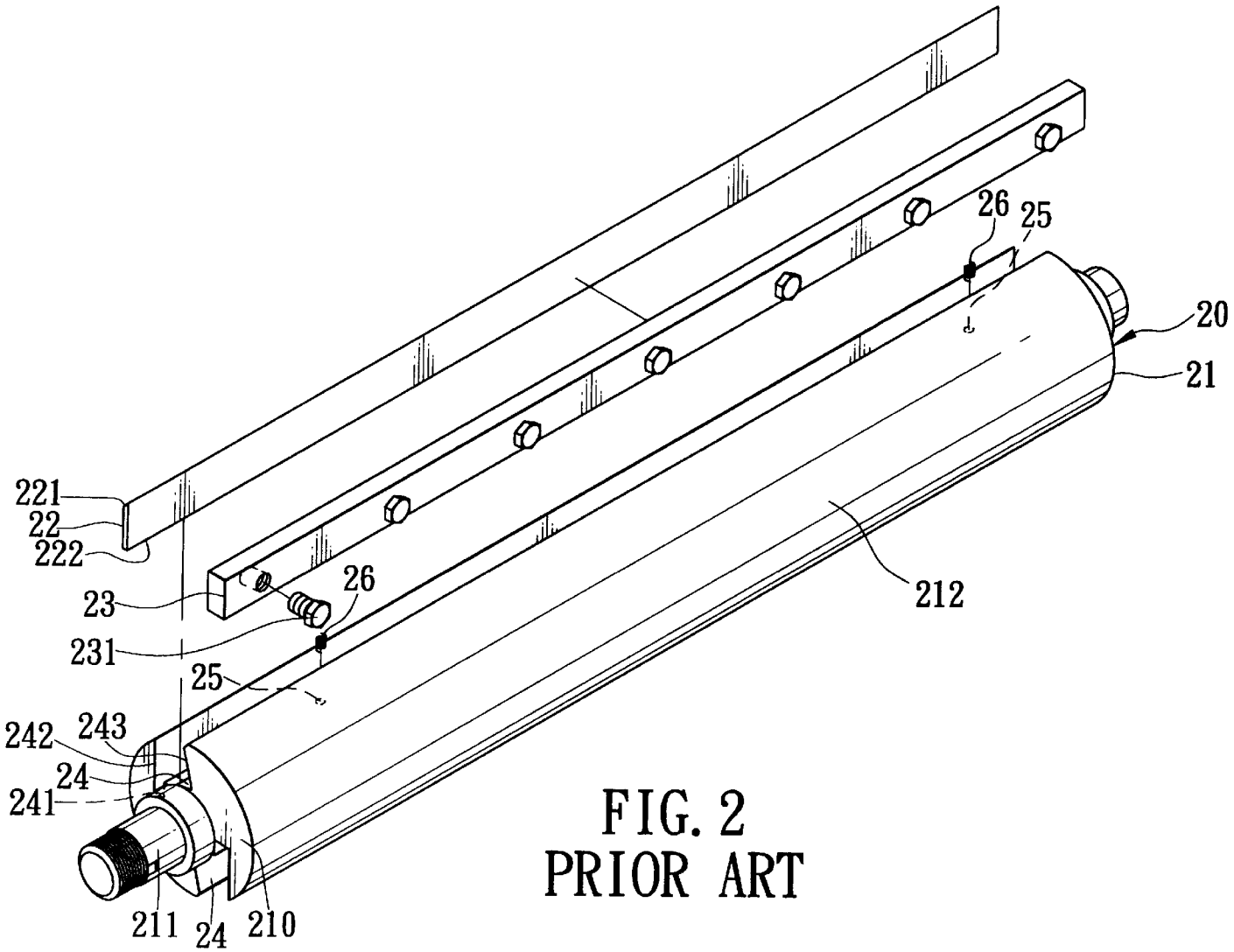
FIG. 2 PRIOR ART
FIG. 2 is an exploded view of the conventional cutter device utilized in the wood planing machine shown in FIG. 1.
Figure 3:
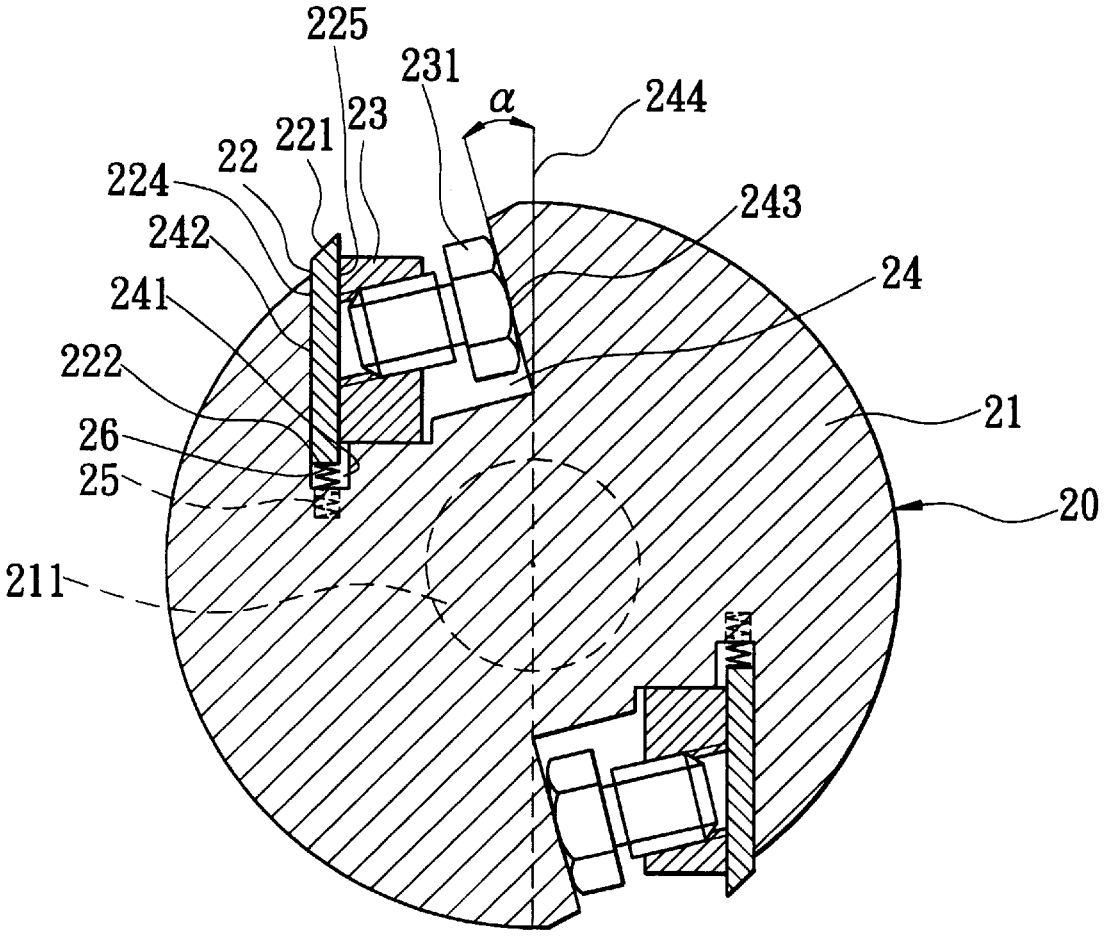
FIG. 3 PRIOR ART
FIG. 3 is a sectional view of the conventional cutter device.
Figure 4:
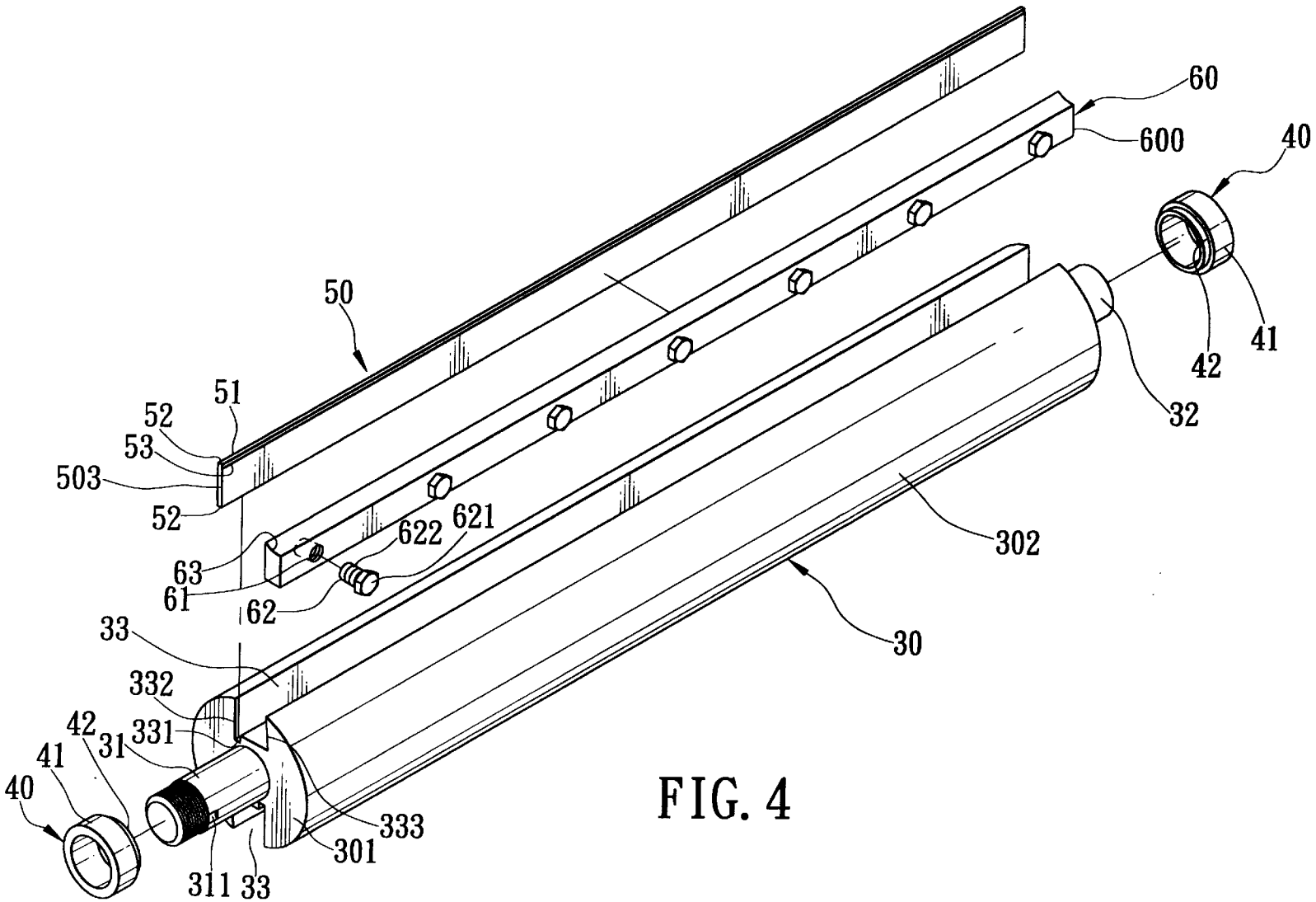
FIG. 4 is an exploded view of the preferred embodiment of a cutter device for a wood planing machine according to the present invention.
Figure 5:
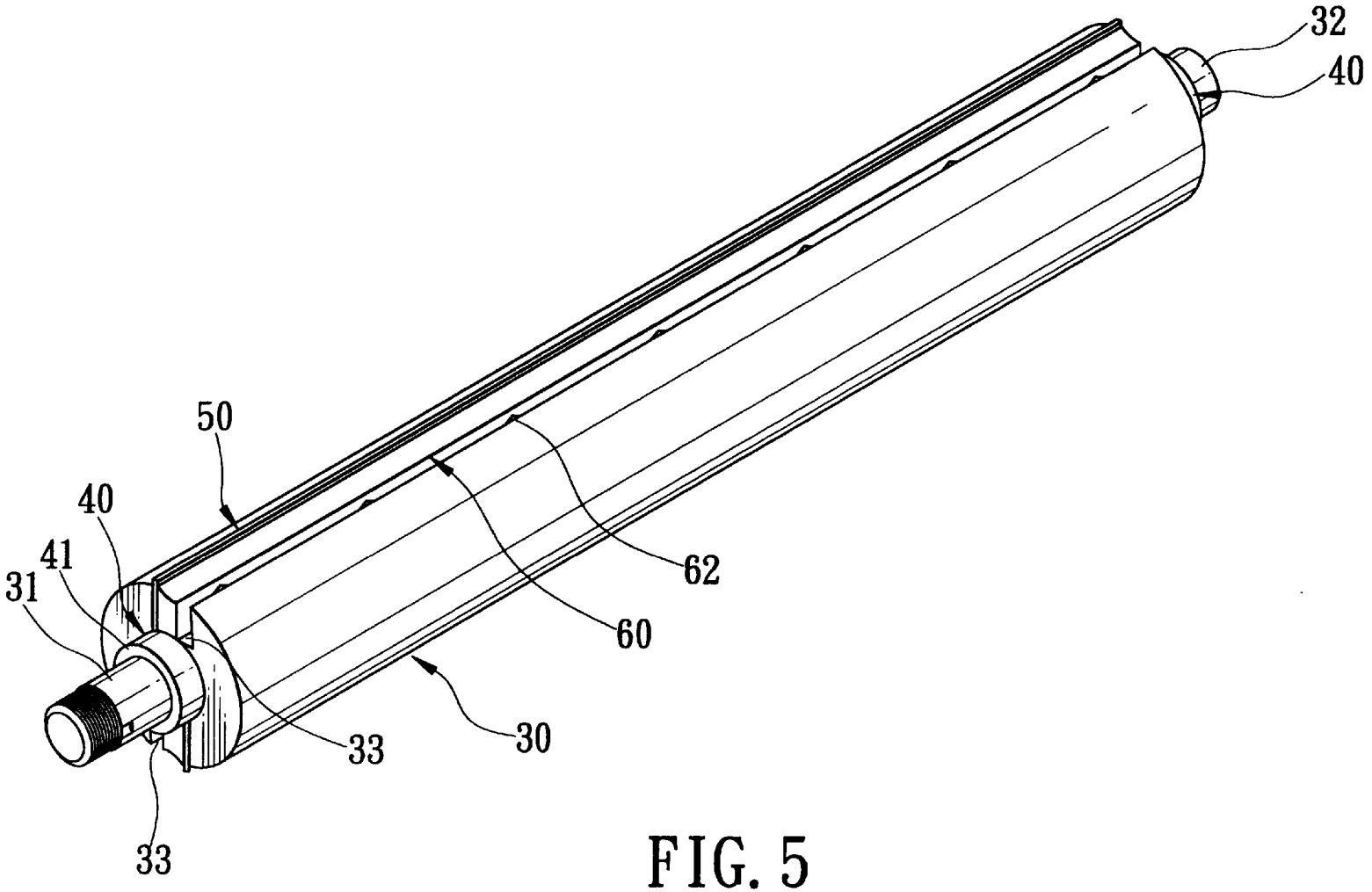
FIG. 5 shows a perspective view of the cutter device of the preferred embodiment.
Figure 6:
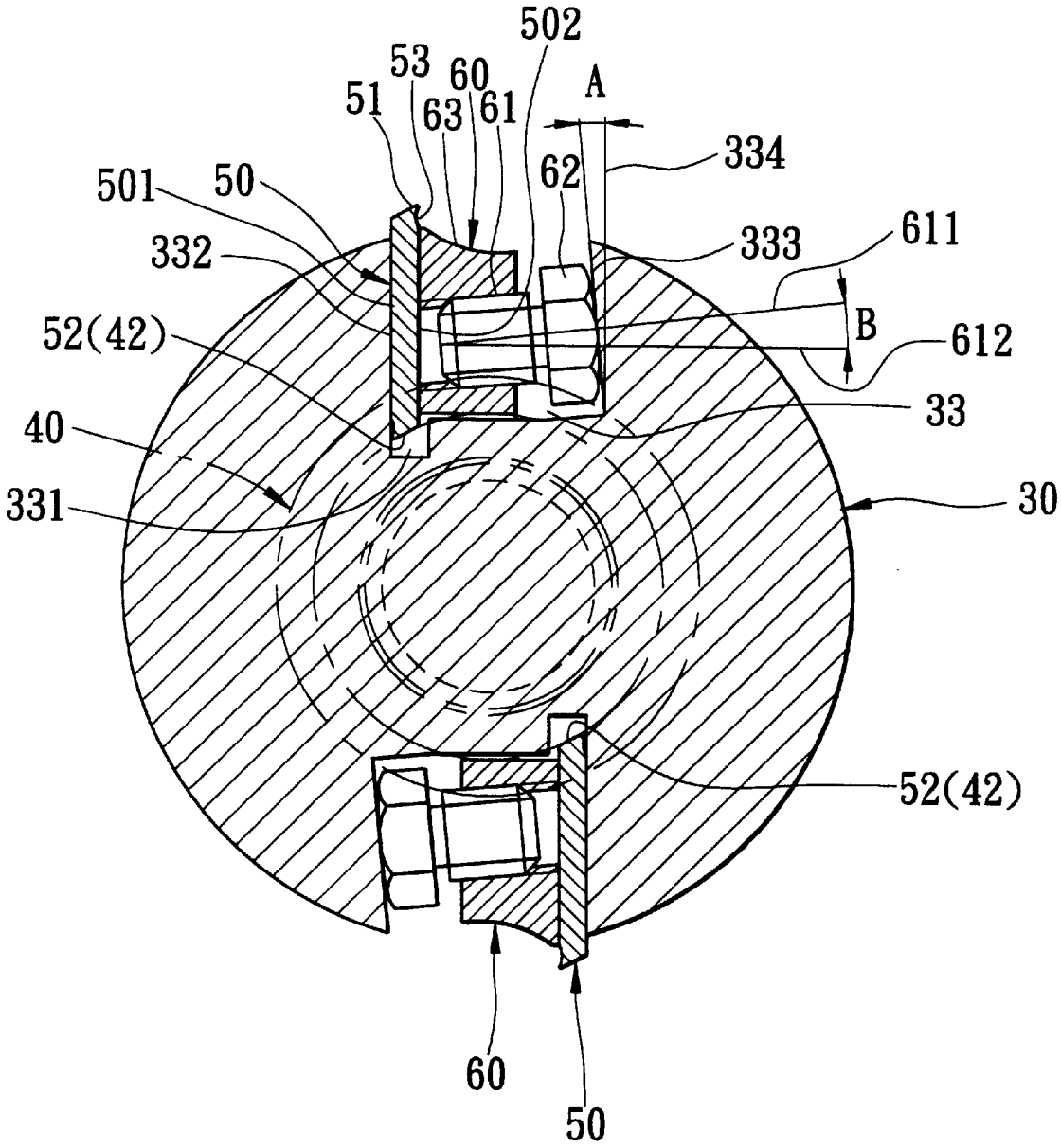
FIG. 6 is a sectional view of the cutter device of the preferred embodiment.

Referring to FIGS. 4, 5 and 6, the preferred embodiment of a cutter device of this invention is adapted for use in a wood planing machine and is shown to include a cylindrical cutter seat 30, a pair of positioning members 40, two elongate cutting blades 50, two elongate press members 60 and two releasable tightening units.

As illustrated, the cylindrical cutter seat 30 has opposite end faces 301 and a cylindrical surface 302 between the end faces 301. Each of the end faces 301 of the cylindrical cutter seat 30 has a coupling shaft 31, 32 that extends co-axially therefrom. The coupling shaft 31 is formed with a key groove 311 for coupling with a motor (not shown). The cylindrical surface 302 is formed with a pair of axially extending cutter receiving grooves 33 that extend from one of the end faces 301 through the other one of the end faces 301. Each cutter receiving groove 33 is defined by a blade supporting wall 332, a fastener bearing wall 333 opposite to the blade supporting wall 332, and a groove bottom 331 that interconnects the blade supporting wall 332 and the fastener bearing wall 333.

Each of the positioning members 40 is sleeved on a respective one of the coupling shafts 31, 32 of the cutter seat 30, and has a large-diameter ring portion 41 and a small-diameter ring portion 42 that extends co-axially from one side of the large-diameter ring portion 41 toward a respective one of the end faces 301 of the cutter seat 30.

Each cutting blade 50 is disposed in the respective cutter receiving groove 33, and has a wall bearing side 501 that leans on the blade supporting wall 332, a force bearing side 502 opposite to the wall bearing side 501, a longitudinal base edge 52, and a longitudinal blade edge 51 that is opposite to the base edge 52 and that projects relative to the cylindrical surface 302 of the cutter seat 302. The cutting blade 50 further has opposite lateral end portions 503, each of which projects relative to a respective one of the end faces 301 of the cutter seat 30 and abuts against the large-diameter ring portion 41 of a respective one of the positioning members 40. The base edge 52 of the cutting blade 50 is supported on the small-diameter ring portions 42 of the positioning members 40 at the lateral end portions 503 of the cutting blade 50.

Each press member 60 is disposed in the respective cutter receiving groove 33 adjacent to the force bearing side 502 of the respective cutting blade 50.

Each releasable tightening unit forces the press member 60 away from the fastener bearing wall 333 to enable the respective press member 60 to press tightly the corresponding cutting blade 50 against the blade supporting wall 332.

In the preferred embodiment, the fastener bearing wall 333 is inclined relative to and intersects a first reference plane 334 that is parallel to the blade supporting wall 332 such that the width of the receiving groove 33 increases in a direction toward the groove bottom 331. Preferably, the fastener bearing wall 333 inclines in a direction toward the blade supporting wall 332 and forms a first acute angle (A) with the first reference plane 334.

Each releasable tightening unit preferably includes a plurality of tightening fasteners 62, each of which has a first portion 621 abutting against the fastener bearing wall 333 and a second portion 622 that engages one side of the respective press member 60 opposite to the corresponding cutting blade 50. Each of the tightening fasteners 62 is formed as a locking bolt having a head that serves as the first portion 621 and an externally threaded shank that serves as the second portion 622.

Each press member 60 is formed with a plurality of internally threaded fastener holes 61 therealong for engaging the fasteners 62. The fastener holes 61 are uniformly spaced apart along a longitudinal direction of the press member 60. Each of the fastener holes 61 has an axis 611 that is inclined relative to and that intersects a second reference plane 612 perpendicular to the first reference plane 334. The axis 611 of each of the fastener holes 611 inclines in a direction away from the groove bottom 331 and forms a second acute angle (B) with the second reference plane 612. In the preferred embodiment, the first and second acute angles (A,B) are generally equal. Preferably, the first and second acute angles (A,B) are about 5 degrees. In addition, the first reference plane 334 and a plane of the blade supporting wall 332 are chordal planes that do not pass through an axis of the cutter seat 30.

Each press member 60 has opposite lateral end portions 600, each of which projects relative to a respective one of the end faces 301 of the cutter seat 30 and abuts against the large-diameter ring portion 41 and is seated on the small-diameter ring portion 42 of a respective one of the positioning members 40. In order to facilitate removal of wood chips resulting from the planing operation, the force bearing side 502 of the cutting blade 50 is formed with a longitudinal chip guiding groove 53 adjacent to the blade edge 51, and the press member 60 has one side distal to the groove bottom 331 and formed with a chip guiding surface 63.

When mounting the cutter device 30 on a carriage assembly of a wood planing machine, the positioning members 40 are press-fitted on the coupling shafts 31,32 of the cutter seat 302. The cutting blades 50 are then disposed in the cutter receiving grooves 33 such that the lateral end portions 503 of the cutting blades 50 abut against the large-diameter ring portions 41 while the base edges 52 thereof are supported on the small-diameter ring portions 42. Under such a condition, the press members 60 can be disposed in the cutter receiving grooves 33 adjacent to the cutting blades 50 and tightly retain the cutting blades 50 in the receiving grooves 33 via the fasteners 62.

Because the cutting blades 50 are supported on the positioning members 40, the problems associated with the use of spring as taught in the aforesaid conventional cutter device can be overcome. In addition, the cylindrical seat 302 has a cross section area that is greater than the cutter seat of the conventional cutter device so that the cutter seat 302 of the present invention is stronger than the prior art cutter seat.

With this invention thus explained, it is apparent that numerous modifications and variations can be made without departing from the scope and spirit of this invention. It is therefore intended that this invention be limited only as indicated in the appended claims.

I claim:

1. A cutter device for a planing machine, comprising:

a cylindrical cutter seat having opposite end faces and a cylindrical surface between said end faces, each of said end faces having a coupling shaft that extends co-axially therefrom, said cylindrical surface being formed with an axially extending cutter receiving groove that extends from one of said end faces through the other one of said end faces, said cutter receiving groove being defined by a blade supporting wall, a fastener bearing wall opposite to said blade supporting wall, and a groove bottom interconnecting said blade supporting wall and said fastener bearing wall;

a pair of positioning members, each of which is sleeved on a respective one of said coupling shafts of said cutter seat, and each of which has a large-diameter ring portion and a small-diameter ring portion that extends co-axially from one side of said large-diameter ring portion toward a respective one of said end faces of said cutter seat;

an elongate cutting blade disposed in said cutter receiving groove, and having a wall bearing side that leans on said blade supporting wall, a force bearing side opposite to said wall bearing side, a longitudinal base edge, and a longitudinal blade edge that is opposite to said base edge and that projects relative to said cylindrical surface of said cutter seat, said cutting blade further having opposite lateral end portions, each of which projects relative to a respective one of said end faces of said cutter seat and abuts against said large-diameter ring portion of a respective one of said positioning members, said base edge being supported on said small-diameter ring portions of said positioning members at said lateral end portions of said cutting blade;

an elongate press member disposed in said cutter receiving groove adjacent to said force bearing side of said cutting blade; and releasable tightening means for forcing said press member away from said fastener bearing wall to enable said press member to press tightly said cutting blade against said base supporting wall.

2. The cutter device as defined in claim 1, wherein said fastener bearing wall is inclined relative to and intersects a first reference plane that is parallel to said blade supporting wall such that width of said receiving groove increases in direction toward said groove bottom.

3. The cutter device as defined in claim 2, wherein said fastener bearing wall inclines in a direction toward said blade supporting wall and forms a first acute angle with said first reference plane.

4. The cutter device as defined in claim 3, wherein said releasable tightening means includes a plurality of tightening fasteners, each of which has a first portion abutting against said fastener bearing wall and a second portion engaging one side of said press member opposite to said cutting blade.

5. The cutter device as defined in claim 4, wherein each of said tightening fasteners is formed as a locking bolt having a head that serves as said first portion and an externally threaded shank that serves as said second portion.

6. The cutter device as defined in claim 5, wherein said press member is formed with a plurality of internally threaded fastener holes therealong for engaging said tightening fasteners.

7. The cutter device as defined in claim 6, wherein said fastener holes are uniformly spaced apart along a longitudinal direction of said press member.

8. The cutter device as defined in claim 6, wherein each of said fastener holes has an axis that is inclined relative to and that intersects a second reference plane perpendicular to said first reference plane.

9. The cutter device as defined in claim 8, wherein said axis of each of said fastener holes inclines in a direction away from said groove bottom and forms a second acute angle with said second reference plane.

10. The cutter device as defined in claim 9, wherein said first and second acute angles are generally equal.

11. The cutter device as defined in claim 9, wherein said first and second acute angles are about 5 degrees.

12. The cutter device as defined in claim 2, wherein said first reference plane and a plane of said blade supporting wall are chordal planes that do not pass through an axis of said cutter seat.

13. The cutter device as defined in claim 1, wherein said press member has opposite lateral end portions, each of which projects relative to a respective one of said end faces of said cutter seat and abuts against said large-diameter ring portion and is seated on said small-diameter ring portion of a respective one of said positioning members.

14. The cutter device as defined in claim 1, wherein each of 'said positioning members is press-fitted on the respective one of said coupling shafts.

15. The cutter device as defined in claim 1, wherein said force bearing side of said cutting blade is formed with a longitudinal chip guiding groove adjacent to said blade edge, and said press member has one side distal to said groove bottom and formed with a chip guiding surface.

* * * * *